United States Patent [19]

Dufour

[11] Patent Number: 4,958,418

[45] Date of Patent: Sep. 25, 1990

[54] LACE TIGHTENING APPARATUS

[75] Inventor: Pierre Dufour, Menthon-St-Bernard, France

[73] Assignee: Salomon S.A., Annecy, France

[21] Appl. No.: 367,748

[22] Filed: Jun. 19, 1989

[30] Foreign Application Priority Data

Jun. 23, 1988 [FR] France ..... 88 08460

[51] Int. Cl.[5] ..... A43B 11/00

[52] U.S. Cl. ..... 24/713.6; 24/713.4

[58] Field of Search ..... 24/140, 141, 145, 146, 24/117 R; 36/50

[56] References Cited

U.S. PATENT DOCUMENTS

| | | | |
|---|---|---|---|
| 239,926 | 4/1881 | Bray | 24/146 |
| 864,774 | 9/1907 | Dunke | 24/145 |
| 963,696 | 7/1910 | Duquette | 24/140 |
| 1,057,382 | 3/1913 | Kramer | 24/140 |
| 1,368,971 | 2/1921 | Ross | 24/146 |
| 1,434,723 | 11/1922 | Triay, Jr. | |
| 1,505,430 | 8/1924 | Roberts et al. | 24/145 |
| 1,850,781 | 3/1932 | Weingarten | 24/140 |
| 1,981,087 | 11/1934 | Brent | |
| 2,038,851 | 4/1936 | Nagamatsu | 24/117 R |
| 4,670,949 | 6/1987 | Autry | 24/141 |

FOREIGN PATENT DOCUMENTS

| | | | |
|---|---|---|---|
| 123031 | 2/1900 | Fed. Rep. of Germany | |
| 224704 | 9/1909 | Fed. Rep. of Germany | 24/140 |
| 497455 | 5/1930 | Fed. Rep. of Germany | |
| 3323170 | 1/1985 | Fed. Rep. of Germany | |
| 323234 | 2/1903 | France | 24/140 |
| 788872 | 10/1935 | France | |
| 1307133 | 9/1962 | France | |
| 2586343 | 2/1987 | France | |
| 403563 | 6/1966 | Switzerland | |
| 771703 | 4/1957 | United Kingdom | |

*Primary Examiner*—Victor N. Sakran

*Attorney, Agent, or Firm*—Sandler, Greenblum & Bernstein

[57] ABSTRACT

A lace tightening apparatus includes hooking elements or eyelets for tightening two portions towards one another. The eyelets are positioned in a single lacing plane and are inclined with respect to the lacing plane by an angle allowing the lace to be in contact with the eyelet only at two opposite points which are spaced from one another in the longitudinal direction. The lace tightening apparatus is particularly useful on a shoe.

24 Claims, 3 Drawing Sheets

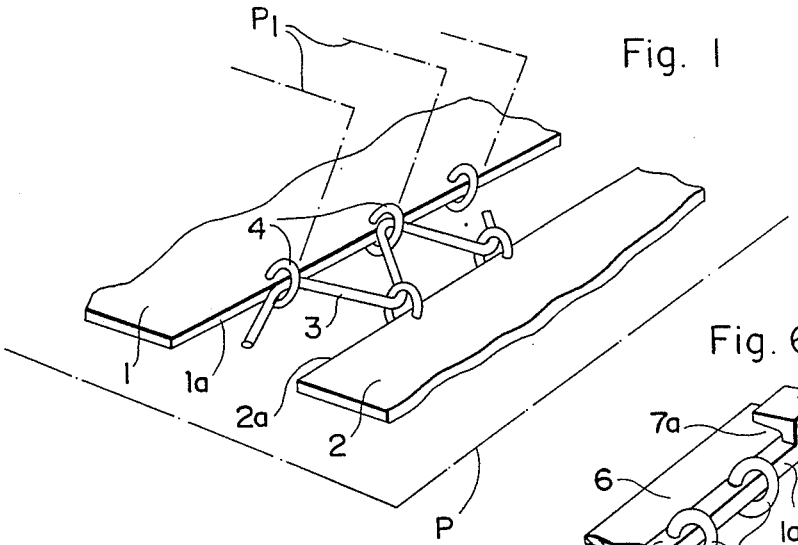
Fig. 1
Fig. 6a
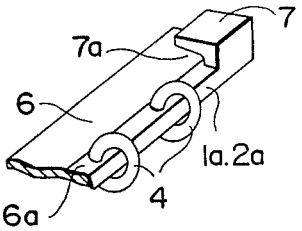
Fig. 2
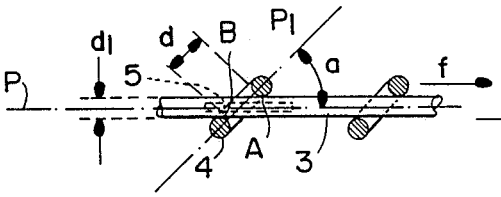
Fig. 3
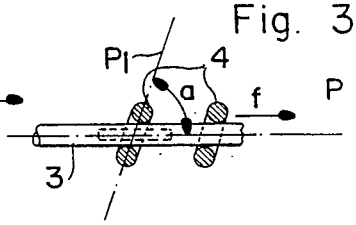
Fig. 4
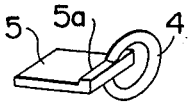
Fig. 5
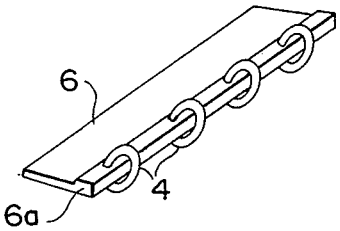
Fig. 6
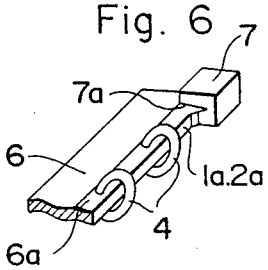

LACE TIGHTENING APPARATUS

BACKGROUND OF THE INVENTION

1. Field of the Invention

The present invention relates to a lace tightening apparatus useful more particularly for a shoe, for example, and in particular, a sports shoe.

2. Description of Background and Relevant Information

Lace tightening apparatus include hooking and/or guidance elements for the lace which are affixed, respectively, on the two portions that are to be brought together and/or tightened towards one another. The hooking and/or guidance elements define a lacing plane. These hooking and/or guidance elements are constituted by eyelets, loops, rivets, guides, grommets, etc. which are distributed along the length of the edges of the two portions to be laced.

In known lace tightening apparatus, the hooking and/or guidance elements of the lace define an opening for passage of the lace which is either contained in the lacing plane or is perpendicular to this plane. In the first case, when the openings of the hooking and/or guidance elements, such as eyelets, are contained in the lacing plane, the lace passes alternately above and beneath the successive eyelets. Such lace tightening apparatus are described, for example, in the following patents: British Pat. No. 771,703; U.S. Pat. No. 1,434,723; German Pat. No. 3,323,170; and French Pat. No. 2,586,343. With these lace tightening apparatus in which the passage of the lace is alternated through the successive hooking and/or guidance elements, relatively high friction of the lace on the hooking elements and on the portions to be tightened will occur (e.g., a tongue of a shoe which is covered by the two portions before being tightened). This causes an irregular tightening which is most often insufficient at the beginning of the lacing.

In the case where the passage openings of the lace in the successive hooking and/or guidance elements extend in planes perpendicular to the lacing plane, the lace passes flat through the openings. Such lace tightening apparatus are described, for example, in German Pat. No. 497,455; Swiss Pat. No. 403,563; and French Pat. No. 1,307,133. In these lace tightening apparatus the design of the hooking elements is relatively complex and when these elements are constituted by hooks, a sure maintenance of the lace in place when the lace is loosened is not guaranteed.

SUMMARY OF THE INVENTION

The present invention relates to a lace tightening apparatus for bringing together and/or tightening two opposite portions against one another where each of the portions have at least one eyelet which are traversed by a lace. Two opposite eyelets are positioned in a single lacing plane that also contains the lace which passes through the eyelets, and each eyelet is inclined with respect to the lacing plane at an angle such that the lace is in contact with each eyelet only at two opposite points which are spaced from one another in the longitudinal direction of the lace.

According to another aspect of the invention, each eyelet is affixed to a flap and each flap is affixed to one of the portions. The eyelet is affixed along the length of an edge of the flap, the length of the edge being reinforced by having an increased thickness over that of the remainder of the flap. The eyelet and the flap form a single element of plastic material. The single element is formed by molding.

According to another aspect of the invention, a plurality of the eyelets are formed on each of the portions. The plurality of eyelets form a group of successive eyelets that are affixed to a longitudinal edge of a single bar. The bar may be rectangular in shape and has a longitudinal edge having an increased thickness over that of the remainder of the bar. The bar and the plurality of eyelets are preferably formed out of a single piece of molded plastic material.

According to still another aspect of the invention, the bar includes a pinching element having a cut-out portion to pinch and immobilize the lace. The pinching element, the bar, and the group of successive eyelets are preferably formed from a single piece of molded material. The cut-out portion of the pinching element may be substantially aligned with openings in the eyelets. Alternatively, the cut-out portion of the pinching element may be offset from the openings in the eyelets.

The eyelets are inclined in the direction in which force is exerted on the lace during tightening. At least one of the eyelets may be inclined at a different angle than others of the eyelets. Alternatively, alternate eyelets of the group of successive eyelets are inclined in the opposite direction from the other eyelets in the group.

According to another aspect of the invention, the two opposite portions are on a shoe. A pinching element may be affixed to a vamp of the shoe to pinch and immobilize the lace.

BRIEF DESCRIPTION OF THE DRAWINGS

The invention will now be described by way of non-limiting embodiments, with reference to various embodiments of the present invention, shown in the annexed drawings in which:

FIG. 1 is a perspective view of a lace tightening apparatus according to the invention;

FIG. 2 is a partial longitudinal cross-sectional view of an eyelet assembly of a tightening apparatus according to the invention;

FIG. 3 is a longitudinal cross-sectional view of an eyelet assembly having an inclination different from those shown in FIG. 2;

FIG. 4 is a perspective view of an independent eyelet;

FIGS. 5, 6 and **6*a*** are perspective views of bars carrying successive eyelets;

DETAILED DESCRIPTION OF PREFERRED EMBODIMENTS

Figure 7:
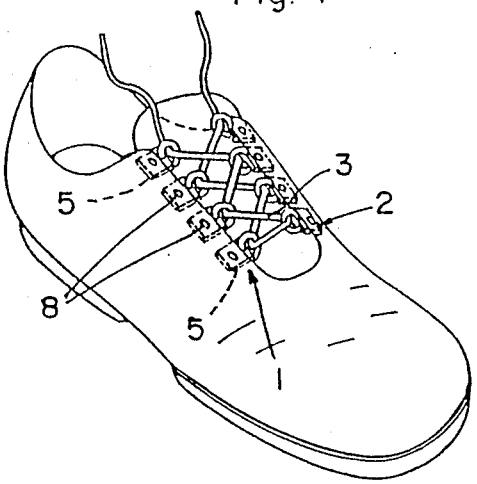
FIGS. 7, 8, 9 and 10 are perspective views of shoes provided with a lace tightening apparatus according to the invention.

The present invention overcomes the disadvantages of the known lace tightening apparatus by providing an apparatus in which the hooking elements of the lace make it possible to maintain the lace in the lacing position, particularly when the lace is loosened, while nevertheless assuring its flat passage with a minimum of friction, in a simple, efficient and inexpensive manner.

To this end, the lace tightening apparatus comprises a succession of eyelets which are traversed one after another by the lace along the length of the edge of each of the two portions to be brought together and/or tightened against one another. The two opposite eyelet assemblies are in a single lacing plane containing the lace passing across the successive eyelets. Each eyelet is contained in a plane which is inclined with respect to the lacing plane by an angle such that during passage across the eyelet, the lace is in contact with the eyelet only at two opposite points which are spaced from one another in the longitudinal direction of the lace.

The lace tightening apparatus which is shown in FIGS. 1 and 2 is adapted to bring together and/or tighten against one another two distant portions 1 and 2 of any article such as a shoe. This tightening is achieved by means of a lace 3 which passes, in a known manner, alternately through eyelets 4 which are distributed in two groups of successive eyelets affixed on the two longitudinal edges 1*a* and 2*a* of the two portions 1 and 2 to be tightened. The lace 3 follows a conventional trajectory by zig-zagging between the eyelets 4 of the two opposite groups, while being contained in the lacing plane P in which the two portions and 2 to be tightened extend.

According to the invention, eyelets 4 are positioned in a manner so as to be held in respective planes P1 which are inclined by an angle a with respect to the lacing plane P. As a result, the lace 3 goes through each eyelet 4 in the lacing plane P and is in contact with each eyelet 4 at two points A and B which are spaced from one another in the longitudinal direction of the lace 3. These points A and B correspond to the tangent points between the external surface of the lace 3 and the peripheral internal surface of eyelet 4.

The angle of inclination a of each eyelet 4 with respect to the lacing plane P is a function of the ratio between the internal diameter d of the eyelet 4 and the external diameter d1 of the lace 3. FIG. 2 illustrates the case where this ratio is relatively high, i.e., where the internal diameter d of the eyelet 4 is much greater than the diameter d1 of lace 3. In this case, the angle of inclination a of the plane Pl of eyelet 4 with respect to the lacing plane P is relatively small, for example approximately 50°.

In the embodiment shown in FIG. 3 the ratio between the diameters d and d1 is slightly greater than 1, i.e., that the internal diameter d of the eyelet 4 is slightly greater than the diameter d1 of the lace 3, and in this case the angle of inclination a of plane P1 of the eyelet 4 with respect to the lacing plane P is greater than in the preceding case, for example approximately 80°.

Preferably, the planes P1 containing the eyelets 4 are inclined in the direction where the tractional force f on the lace 3 during tightening is exerted.

Since lace 3 is in contact with each eyelet 4 at two opposite points A and B, it is maintained by friction at the contact points A and B when the lace is loosened, while allowing for its flat passage in the lacing plane P. Therefore, there is minimum friction during lacing.

Each eyelet 4 can be affixed individually to the two portions 1 and 2 to be tightened. Thus, an eyelet can be affixed, as is shown in FIG. 4, to a flap 5 which is individually affixed to the two portions 1 and 2, for example, by stitching, riveting, etc. The flap 5 can preferably be reinforced along its edge which is affixed the eyelet 4 by an edge 5*a* in which the thickness is increased. In this case, the eyelet 4 is affixed to the flap 5 while being inclined by angle a with respect to the plane of this flap. Preferably, the eyelet 4 and the flap 5 form a single element made of plastic material formed by molding.

In the embodiment shown in FIG. 5, the eyelets 4 form a group of successive eyelets and are affixed to the longitudinal edge of a single bar 6, preferably having a generally rectangular shape, and preferably formed from a flexible or semi-flexible material. Further, the bar 6 is preferably formed with an increased thickness forming a consolidation edge 6*a* along its edge where successive eyelets 4 are affixed. The bar 6 and the eyelets 4 are preferably formed from a single piece of molded plastic material.

In the embodiments shown in FIGS. 6 and 6*a* the bar 6 is provided at its rear end with an element 7 which makes it possible to pinch lace 3. Element 7, which is preferably formed by molding with bar 6 and eyelets 4, has a cut-out 7*a* in which the lace 3 can be pinched. Depending upon the tightening effect desired, element 7 can be positioned either substantially in alignment with eyelets 4 (FIG. 6) or offset from the alignment of the eyelets 4 (FIG. 6*a*).

FIG. 7 shows a shoe whose inclined eyelets 4 are affixed to independent flaps 5 which are in turn affixed by rivets 8 to the two portions 1 and 2 to be tightened.

Figure 8:
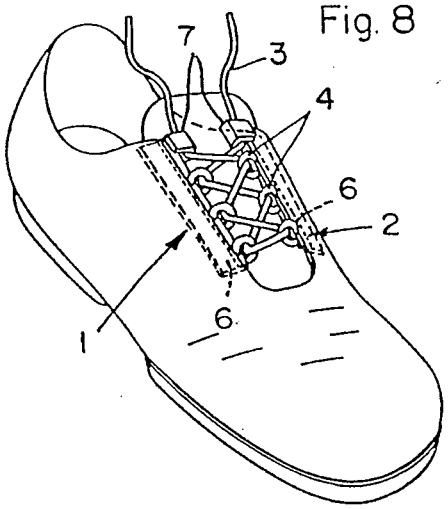

FIG. 8 shows a shoe whose two portions to be tightened 1 and 2 support bars 6 to which are affixed inclined eyelets 4. These bars are affixed to the two portions 1 and 2 of the shoe by stitching, for example. The two bars 6 are provided with pinching elements 7 at their rear ends to immobilize the lace 3.

Figure 9:
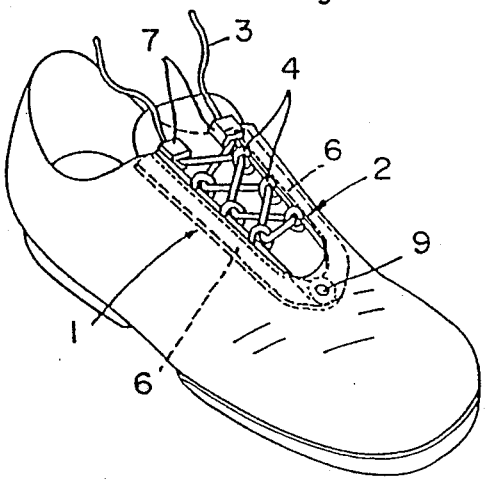

FIG. 9 shows a shoe in which the inclined eyelets 4 through which the tightening lace 3 extends are affixed to two bars 6 which are each journalled at their front ends for movement about an axis 9, this axis 9 being, if desired, affixed to the vamp of the shoe.

Figure 10:
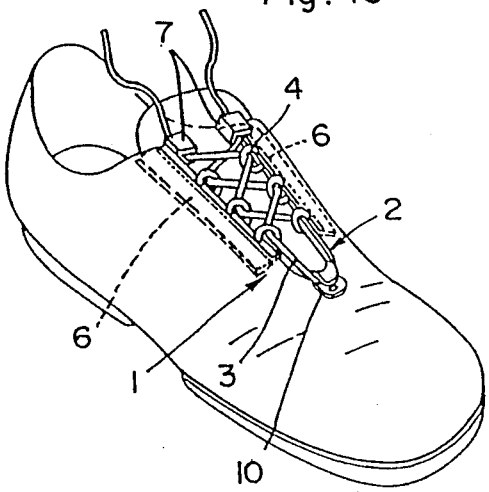

FIG. 10 shows a shoe of the type illustrated in FIG. 8, whose tightening lace 3 forms a loop by passing over a front pinching element 10 affixed to the vamp of the shoe.

Figure 11:
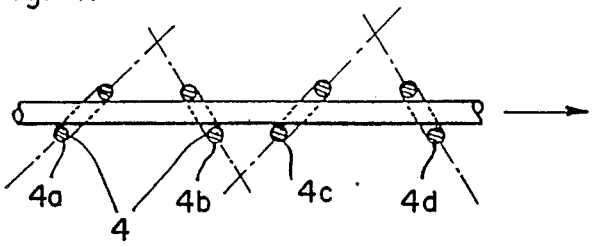
FIGS. 11 and 12 are longitudinal cross-sectional views of alternative eyelet arrangements.

FIG. 11 shows an alternative embodiment of the lace tightening apparatus according to the invention in which the successive eyelets of a single group are alternately inclined and in opposite directions. In the succession of eyelets 4*a*, 4*b*, 4*c*, 4*d*, the odd rows of eyelets 4*a*, 4*c* are inclined towards the right, while the even rows of eyelets 4*b* and 4*d* are inclined towards the left. The angle of inclination of the odd rows of eyelets 4*a* and 4*c* may be equal to the angle of inclination in the opposite direction of the even rows of eyelets 4*b* and 4*d*, or these angles can have different values.

Figure 12:
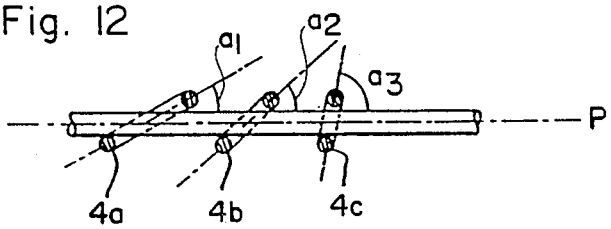

FIG. 12 shows another alternative embodiment in which the successive eyelets 4*a*, 4*b*, 4*c* of a single group of eyelets are inclined by different angles with respect to the lacing plane. The first eyelet 4*a* of relatively large diameter is inclined, with respect to the lacing plane P, by an acute angle a1 which is less than the acute angle a2 of the second eyelet 4*b*, which is itself less than the angle a3 of the third eyelet 4*c* since the second and third eyelets have successively small diameters.

Figure 13:
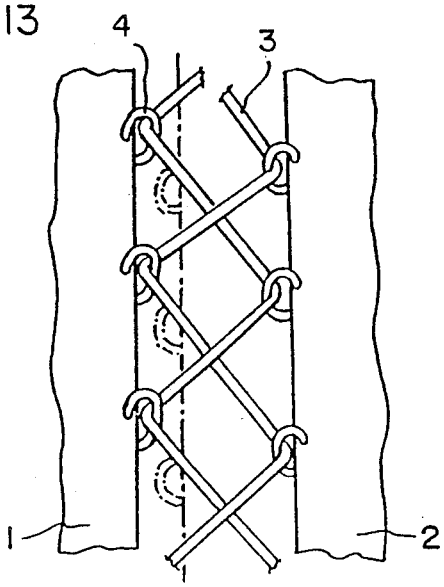
FIG. 13 is a planar view of a type of lacing having eyelets which are inclined according to the invention.

FIG. 13 illustrates another embodiment, in which the eyelets 4 of the two opposite groups are slightly offset longitudinally with respect to one another so that, in the maximum tightening position, the eyelets of the right eyelet group can be positioned in the spaces between the eyelets 4 of the left eyelet group, as is indicated in dashed lines in the drawing.

Although the invention has been described with reference to particular means, materials and embodiments, it is to be understood that the invention is not limited to the particulars disclosed and extends to all equivalents within the scope of the claims.

What is claimed:

1. A lace tightening apparatus for tightening two opposite portions against one another comprising:

at least one eyelet mounted on each of said two opposite portions which are to be traversed by a lace, the two opposite eyelets being positioned substantially in a single lacing plane that also contains the lace which passes through the eyelets; and each said eyelet being inclined with respect to said lacing plane at an angle such that the lace is in contact with each said eyelet only at two opposite points which are spaced from one another in the longitudinal direction of the lace, each of said opposite points being a tangent point between a surface of said lace and a surface of said eyelet.

2. The lace tightening apparatus according to claim 1, wherein each said eyelet is affixed to a respective flap, each said flap being affixed to one of said portions.

3. The lace tightening apparatus according to claim 2, wherein each said eyelet and said respective flap form a single element of plastic material.

4. The lace tightening apparatus according to claim 5, wherein said single element is formed by molding.

5. The lace tightening apparatus according to claim 2, wherein each said eyelet is affixed along the length of an edge of said flap, the length of said edge being reinforced.

6. The lace tightening apparatus according to claim 3, wherein said edge is reinforced by having an increased thickness over that of the remainder of said flap.

7. The lace tightening apparatus according to claim 1, comprising a plurality of said eyelets on each of said portions, each said plurality of eyelets forming a group of successive eyelets that are affixed to a longitudinal edge of a single bar.

8. The lace tightening apparatus according to claim 7, wherein said bar is substantially rectangular in shape.

9. The lace tightening apparatus according to claim 7, wherein said longitudinal edge has an increased thickness over that of the remainder of said bar.

10. The lace tightening apparatus according to claim 7, wherein said bar and said plurality of eyelets are formed from a, single piece of molded plastic material.

11. The lace tightening apparatus according to claim 7, wherein said bars are each journalled at one end about a pivot attached to a vamp of a shoe.

12. The lace tightening apparatus according to claim 7, wherein said bar includes a pinching element having a cut-out portion to pinch and immobilize the lace.

13. The lace tightening apparatus according to claim 11, wherein said pinching element, said bar, and said group of successive eyelets are formed from a single piece of molded material.

14. The lace tightening apparatus according to claim 11, wherein said cut-out portion of said pinching element is substantially aligned with openings in said eyelets.

15. The lace tightening apparatus according to claim 11, wherein said cut-out portion of said pinching element is offset from openings in said eyelets.

16. The lace tightening apparatus according to claim 1, wherein each said eyelet is inclined in the direction in which force is exerted on the lace during tightening.

17. The lace tightening apparatus according to claim 1, comprising a plurality of eyelets on at least one of said portions, at least one of said eyelets being inclined at a different angle than others of said eyelets.

18. The lace tightening apparatus according to claim 1, comprising a plurality of eyelets on at least one of said portions, said plurality of eyelets forming a group of successive eyelets, and wherein alternate eyelets of said group of successive eyelets are inclined in the opposite direction from the other eyelets in said group of successive eyelets.

19. The lace tightening apparatus according to claim 1, wherein said two opposite portions are on a shoe.

20. The lace tightening apparatus according to claim 18, and further comprising a pinching element affixed to a vamp of the shoe to pinch and immobilize the lace.

21. A lace tightening apparatus for tightening two opposite portions against one another comprising:

a plurality of eyelets mounted on each of said two opposite portions which are to be traversed by a lace, the two opposite plurality of eyelets being positioned substantially in a single lacing plane that also contains the lace which passes through the eyelets, each said plurality of eyelets forming a group of successive eyelets that are affixed to a longitudinal edge of a single bar, said bar including a pinching element having a cut-out portion to pinch and immobilize the lace; and each said eyelet being inclined with respect to said lacing plane at an angle such that the lace is in contact with each said eyelet only at two opposite points which are spaced from one another in the longitudinal direction of the lace.

22. The lace tightening apparatus according to claim 21, wherein said pinching element, said bar, and said group of successive eyelets are formed from a single piece of molded material.

23. The lace tightening apparatus according to claim 21, wherein said cut-out portion of said pinching element is substantially aligned with openings in said eyelets.

24. The lace tightening apparatus according to claim 21, wherein said cut-out portion of said pinching element is offset from openings in said eyelets.

* * * * *